US005103533A

United States Patent [19]

Pettit et al.

[11] Patent Number: 5,103,533

[45] Date of Patent: Apr. 14, 1992

[54] LOCK HANDLE PIVOT STRUCTURE

[75] Inventors: Dean A. Pettit, Owatonna; Jeffrey L. Sullivan, Albert Lea, both of Minn.

[73] Assignee: Truth Division of SPX Corporation, Owatonna, Minn.

[21] Appl. No.: 621,758

[22] Filed: Dec. 4, 1990

[51] Int. Cl.[5] ..... E05C 19/12; E05B 65/00

[52] U.S. Cl. ..... 16/342; 16/337; 16/DIG. 33; 29/523; 403/153

[58] Field of Search ..... 16/228, 231, 337, 342, 16/DIG. 33, 338, 383, 339, DIG. 6; 70/89, 90; 292/101, DIG. 20, DIG. 30, DIG. 33; 29/434, 436, 437, 523, 11; 403/152, 153, , 277, 279

[56] References Cited

U.S. PATENT DOCUMENTS

| | | | |
|---|---|---|---|
| 1,798,890 | 3/1931 | Mayo et al. | 29/437 |
| 2,422,327 | 6/1947 | Winslow | 403/152 |
| 2,613,525 | 10/1952 | Holmsten | 70/89 |
| 2,774,098 | 12/1956 | Tieri | 16/228 |
| 2,828,668 | 4/1958 | De Angelis | 16/228 |
| 2,939,168 | 6/1960 | Ferron | 16/228 |
| 3,042,961 | 7/1962 | Tieri | 16/228 |
| 3,270,536 | 9/1966 | Sprung | 70/89 |
| 4,018,104 | 4/1977 | Bland et al. | 74/531 |
| 4,256,388 | 3/1981 | Beyer | 16/228 |
| 4,428,094 | 1/1984 | Emain | 16/342 |
| 4,586,750 | 5/1986 | Vogel | 16/DIG. 6 |
| 4,630,332 | 12/1986 | Bisbing | 16/273 |
| 4,630,333 | 12/1986 | Vickers | 16/342 |
| 4,638,544 | 1/1987 | McNeil | 29/434 |
| 4,639,147 | 1/1987 | Schwarz | 16/342 |
| 4,821,374 | 4/1989 | Gavagan | 16/321 |
| 4,844,606 | 7/1989 | Smith | 16/228 |

*Primary Examiner*—Lowell A. Larson
*Assistant Examiner*—D. M. Gurley
*Attorney, Agent, or Firm*—Wood, Phillips, Mason, Recktenwald & VanSanten

[57] ABSTRACT

A pivotal connection between a handle and a housing, where the handle includes a cylindrical opening, and the housing includes a pair of cylindrical openings on opposite sides of the housing and concentric with the handle opening. A sleeve with a central tubular opening is disposed within the housing and handle openings, and has an outer diameter substantially equal to the diameter of the housing and handle openings. A cylindrical pin has an outer diameter greater than the inner diameter of the sleeve tubular opening and is wedged into the sleeve tubular opening to bulge the sleeve outwardly into beveled portions of the handle opening. The connection is formed by first aligning the handle between housing portions so that openings therethrough are disposed substantially concentric to one another. Then, a tubular sleeve is located within the housing and handle openings. Finally, a pin having an outer diameter greater than the inner diameter of the tubular sleeve opening is wedged into the sleeve opening.

9 Claims, 1 Drawing Sheet

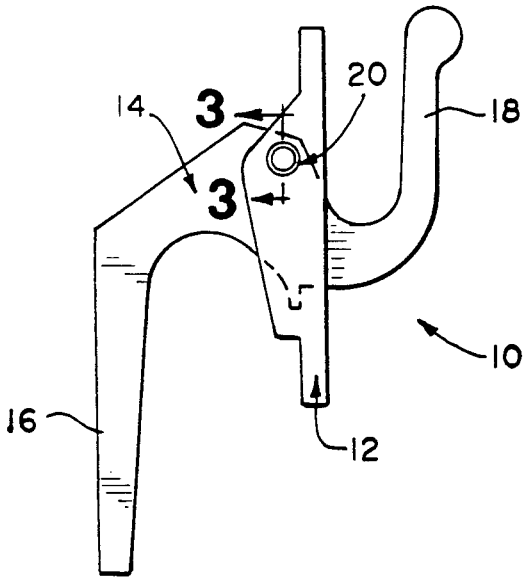
Fig. 1
Fig. 2
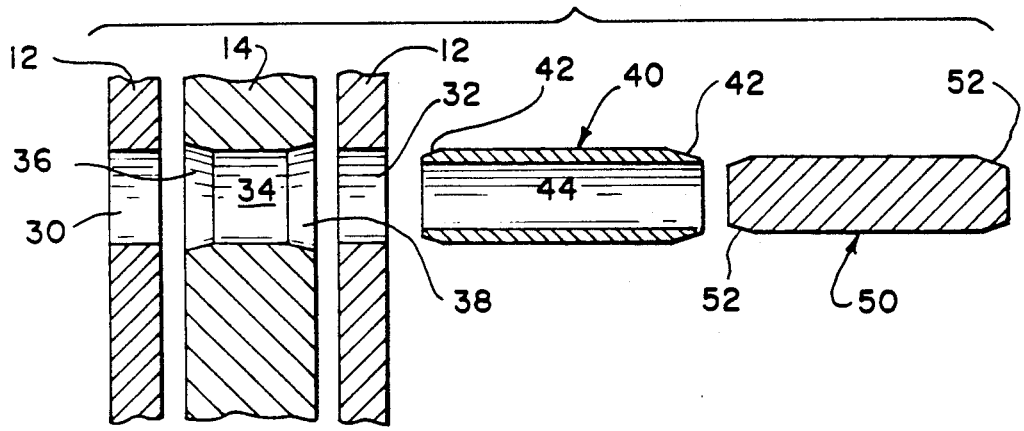
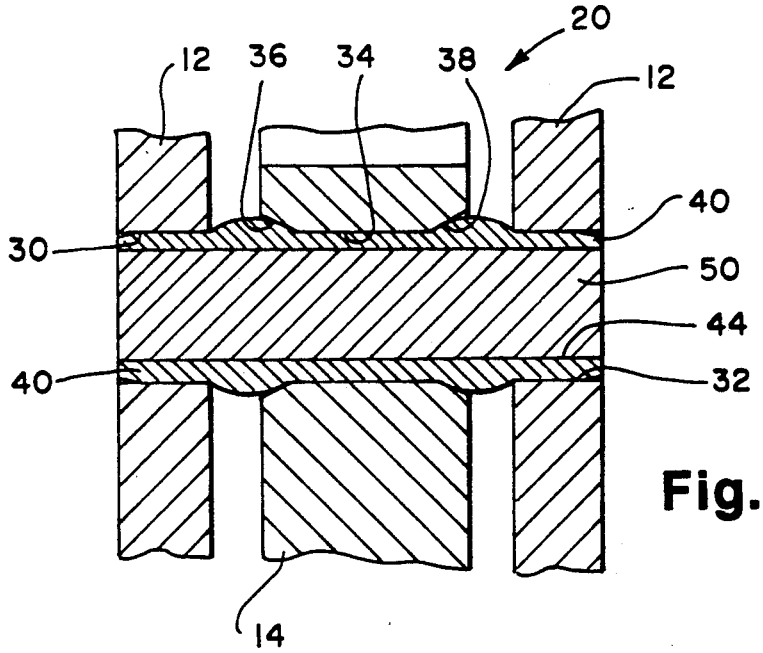
Fig. 3

LOCK HANDLE PIVOT STRUCTURE

BACKGROUND OF THE INVENTION

1. Technical Field

The present invention is directed toward pivot structures, and more particularly toward a pivot structure for connecting a window lock handle to its housing.

2. Background Art

Window locks are, of course, well known. One common window lock type uses a handle pivotally mounted to a housing which is itself mounted to the window frame, and a keeper is mounted to the movable window sash. The handle may be manually pivoted to move a grasping member into and out of engagement with the keeper to lock or release the window sash as desired.

Commonly, such lock handles have been pivotally secured to the housing by a rivet. Further, a spring washer has commonly been disposed between the handle and the housing, such washer frictionally engaging the handle to create a torque necessary to operate (i.e., pivot) the handle. However, such lock structures can have a tendency to lose the operating torque initially manufactured into the lock, such that the handle eventually may be able to rotate freely relative to the housing. In installations where there are two such locks and the sash is moved by an operator crank, this can make it virtually impossible for one person to open or close the window (needless to say, it is very difficult for a person having only two hands to hold two lock handles in the necessary position while also turning the operator crank).

Still other pivot structures are, of course, known and used in other types of environments as shown, for example, in U.S. Pat. Nos. 4,821,374, 4,639,147, 4,638,544, 4,630,333, 4,630,332, 4,586,750, and 4,018,104. However, these structures do not solve the above mentioned problem of failure to retain initial operating torque, are difficult to assemble, are undesirably expensive to manufacture, and/or are not readily adaptable for use in the limited space allowed for such window lock pivots.

The present invention is directed toward overcoming one or more of the problems set forth above.

SUMMARY OF THE INVENTION

In one aspect of the present invention, a pivotal connection is provided between a handle and a housing. The handle includes a cylindrical opening, and the housing includes a pair of cylindrical openings on opposite sides of the housing and concentric with the handle opening. A sleeve with a central tubular opening is disposed within the housing and handle openings, and has an outer diameter substantially equal to the diameter of the housing and handle openings. A cylindrical pin has an outer diameter greater than the inner diameter of the sleeve tubular opening and is wedged into the sleeve tubular opening.

In a preferred embodiment of the present invention, the handle opening is beveled outwardly at both ends and the pin bulges the sleeve outwardly into the beveled portions.

In a still further preferred embodiment of the present invention, the handle is the locking handle of a window lock, and the handle is frictionally maintained in position relative to the housing until moved by an operator.

In another aspect of the present invention, a method for pivotally connecting a handle to a housing is disclosed, including first aligning the handle between housing portions with openings therethrough being disposed substantially concentric to one another. Then, a tubular sleeve is located within the housing and handle openings. Finally, a pin having an outer diameter greater than the inner diameter of the tubular sleeve opening is wedged into the sleeve opening.

It is an object of the invention to provide a pivot structure which will retain its operating torque over an extended period of time. It is thus a further object of the invention to provide a window lock in which the handle does not pivot freely even after extensive use, thereby ensuring that a single person may reliably control multiple locks and a window operator at the same time during opening and closing operations.

It is another object of the invention to provide a pivot structure which may be easily and inexpensively manufactured.

It is still another object of the invention to provide a reliable and compact pivot structure which may be used in applications where only minimal space is provided for such pivots.

BRIEF DESCRIPTION OF THE DRAWINGS

FIG. 1 is a side view of a handle and housing construction having the pivotal connection of the present invention;

FIG. 2 is a cross-sectional and exploded view of the pivotal connection of the present invention; and FIG. 3 is a cross-sectional view of the pivotal connection taken along line 3—3 of FIG. 1.

DESCRIPTION OF THE PREFERRED EMBODIMENT

A window lock structure 10 embodying the pivot construction of the present invention is shown in FIG. 1. The lock structure 10 includes a base housing 12 with a handle 14 extending through a slot in the housing 12. Typically, the housing 12 is suitably secured (for example, by screws) to the face of a window frame (not shown). The handle 14 includes a handle portion 16 which projects into the dwelling and a grasping portion 18 projecting toward the window sash (also not shown) for grasping a keeper on the sash for locking.

The handle 14 is pivotally secured to the housing 12 by the pivot construction 20 described below.

Specifically, in the preferred construction shown in FIGS. 2 and 3, the housing 12 includes a pair of coaxial cylindrical openings 30, 32. The handle 14 also has a cylindrical opening 34 having a diameter substantially equal to the diameter of the housing openings 30, 32, with both ends 36, 38 of the handle opening 34 being tapered or beveled outwardly.

The pivot construction is formed by first inserting a tubular sleeve 40 through the housing and handle openings 30, 32, 34. Preferably, the sleeve 40 should have an outer diameter substantially equal to or slightly less than the diameter of the openings 30, 32, 34 so that it may be easily placed in the openings by manual assembly. The sleeve 40 could, however, have a slightly greater diameter than the openings 30, 32, 34 so that a slight frictional force would hold the sleeve 40 in place when first located in the openings 30, 32, 34 during assembly although, in that case, the diameter should preferably not be so great as to make it difficult to manually insert the sleeve 40 into the openings 30, 32, 34.

Further, the sleeve 40 preferably has ends 42 which are tapered down to a diameter well less than the diameter of the openings 30, 32, 34 to ease assembly when initially inserting the sleeve 40 into the openings (although only one tapered end is necessary, by tapering both ends 42 the sleeve 40 may be quickly assembled without any need for the assembler to first identify which end to insert first).

The sleeve 40 further includes an axial opening 44 through its center so that, when the sleeve 40 is in place in the openings 30, 32, 34, a pin 50 is forced into the sleeve opening 44. More specifically, the pin 50 has an outer diameter greater than the diameter of the sleeve opening 44 and further includes tapered ends 52 to facilitate initial insertion of the pin 50 into the sleeve 40. The pin 50 may therefore by readily forced into the sleeve 40 by simple manual techniques, as by supporting the opposite side of the housing 12 on an anvil type surface and simply hammering the pin 50 into the sleeve 40 from the other side.

Preferably, the sleeve 40 is made of plastic such as acetal which will creep as described below. The pin 50 is also preferably made of such a material although, as will be recognized once an understanding of the present invention is obtained, the pin 50 could also be made of a harder material, including metal.

As best shown in FIG. 3, the completed pivot construction will result in a press fit between the both ends of the sleeve 40 and the housing 12. Further, the plastic sleeve 40 is similarly press fit within the handle opening 34 and, in fact, swells to creep into the beveled ends 36, 38 of the handle opening 34. (It should also be understood that while FIG. 3 does generally illustrate the important outer profile of the sleeve 40, the exact profile of the engagement between the sleeve 40 and the pin 50 is complicated and, in any event, dependent on the materials of each part, and therefore may not actually be a uniform cylinder as shown in FIG. 3.)

As will be recognized by those who have obtained an understanding of the present invention, in order to obtain the above described configuration, it is generally necessary that the outer diameter of the pin 50 be greater than the inner diameter of the sleeve opening 44 by an amount which is greater than the outer diameter of the sleeve 40 is less than diameter of the housing and handle openings 30, 32, 34. That is:

$$P-S_i>H-S_o$$

WHERE:

P=the outer diameter of the pin;

$S_i$=the inner diameter of the sleeve opening;

H=the inner diameter of the handle and housing openings; and $S_o$=the outer diameter of the sleeve.

Perhaps most simply put, the pin 50 must be sufficiently large to ensure that it will swell the sleeve 40 against the housing and handle openings 30, 32, 34 and bulge into the beveled ends 36, 38.

Further, it has been found that a pin 50 having an outer diameter at least 5% greater than the diameter of the sleeve opening 44 is preferred to obtain the above described configuration.

Consistent with the above, it has been found, for example, that with housing and handle openings 30, 32, 34 having a diameter in the 0.245" to 0.25" range, a sleeve 40 having an outer diameter of approximately 0.24" and an inner diameter of approximately 0.195" works suitably with a pin 50 having an outer diameter of approximately 0.21".

As will be recognized by those having an understanding of the present invention, the above described unique sleeve and pin construction is not only simple; it is also sturdy. For example, since the sleeve 40 is not under any outward pressure when it is inserted into the housing 12 and handle 14 (which are typically both metal), the sleeve 40 does not rub against the walls of the openings 30, 32, 34. The pressure is only later added when the pin 50 is inserted Therefore, there is no danger of shaving off the outer surface of the sleeve 40 on burrs in the handle 14 and/or housing 12 during assembly (as there would be if, for example, a single oversized pin were forced into the housing and handle openings).

The above described pivot construction clearly can be easily and inexpensively manufactured to provide a reliable, wobble free pivot axis for the handle 14.

Further, it has been found that the plastic sleeve 40 wears better during repeated pivots of the handle 14 than does the metal on metal structures of the prior art, so that the pivot structure of the present invention will retain its operating torque over an extended period of time. Therefore, the tendency of prior art window locks to pivot freely after repeated use is avoided, thereby ensuring that a single person may reliably control multiple locks and a window operator at the same time during opening and closing operations of a window.

Still further, this construction provides that reliable operating torque while still using only minimal space (i.e., it simply defines a pivot shaft without requiring other bulky components as found with some prior art pivots), and thus may readily be used with most existing pivotable handle structures.

Still other aspects, objects, and advantages of the present invention can be obtained from a study of the specification, the drawings, and the appended claims.

We claim:

1. A pivotal connection between a handle and a housing, comprising:

a cylindrical opening through the handle having outwardly beveled portions at both ends thereof;

a pair of cylindrical openings through said housing, said housing openings being concentric with and on opposite sides of the handle opening;

a deformable sleeve with a central tubular opening, said sleeve having an outer surface in frictional contact with the handle opening, handle opening beveled portions, and housing openings; and a cylindrical pin disposed within said sleeve tubular opening and biasing said sleeve radially outwardly into said frictional contact.

2. The connection of claim 1, wherein said sleeve is made of plastic.

3. The connection of claim 1, wherein said handle is the locking handle of a window lock, and said handle is frictionally maintained in position relative to the housing until moved by an operator.

4. In a window lock having a handle with a grasping portion for grasping a keeper, said handle extending through a slot in a base housing and being pivotally connected thereto, said handle and housing pivotal connection comprising:

a handle pivot portion disposed within said housing slot and having a cylindrical opening with a first diameter, each end of the cylindrical opening being tapered outwardly to a diameter greater than the first diameter;

coaxial cylindrical openings on opposite sides of the housing slot, each of said housing openings having a selected diameter substantially equal to the first diameter;

a plastic tubular sleeve within the housing openings and handle pivot portion cylindrical opening, said sleeve including an axial cylindrical opening and an outer surface; and a cylindrical pin disposed within said sleeve opening and biasing said sleeve radially outwardly beyond the first diameter with its outer surface in frictional engagement with the housing and handle cylindrical openings and the tapered ends of the handle cylindrical opening.

5. A method for pivotally connecting a handle to a housing, comprising the steps of:

aligning the handle between housing portions with openings through said handle and said housing portions being disposed substantially concentric to one another, with the handle opening having ends beveled outwardly to a diameter greater than the diameter of the housing portion openings;

locating a sleeve within said housing and handle openings, said sleeve having a central tubular opening with a selected inner diameter no greater than the diameter of the housing portion openings; and forcing a pin into said sleeve tubular opening, said pin having an outer diameter greater than the sleeve opening inner diameter to deform said sleeve radially outwardly against said housing portion openings and into said handle opening beveled ends.

6. A pivotal connection between a handle and a housing, comprising:

a cylindrical opening through the handle having outwardly beveled portions at both ends thereof;

a pair of cylindrical openings through said housing, said housing openings being concentric with and on opposite sides of the handle opening;

a cylindrical pin having a selected outer diameter;

a deformable sleeve with a central tubular opening receiving said pin, said sleeve having an outer surface biased outwardly into frictional contact with the handle opening, handle opening beveled portions, and housing openings by providing a sleeve with an outer diameter substantially equal to or less than the diameter of said housing and handle openings and a tubular opening inner diameter less than the selected outer diameter of the pin, locating said sleeve within said housing and handle openings, and forcing said pin into said sleeve tubular opening.

7. The connection of claim 6, wherein the pin is tapered on one end to an outer diameter less than the inner diameter of the undeformed sleeve tubular opening.

8. The connection of claim 6, wherein said pin outer diameter is at least 5% greater than the inner diameter of the undeformed sleeve tubular opening.

9. The connection of claim 6, wherein said undeformed sleeve outer diameter is less than the diameter of the housing and handle openings by an amount which is less than the pin outer diameter is greater than the undeformed sleeve opening inner diameter.

* * * * *